US006068142A

United States Patent [19]

Primiano

[11] Patent Number: 6,068,142

[45] Date of Patent: May 30, 2000

[54] FRONT PANEL FOR A DISPLAY RACK

[75] Inventor: Bernard Primiano, Marietta, Ga.

[73] Assignee: Display Industries, LLC, Smyrna, Ga.

[21] Appl. No.: 09/321,037

[22] Filed: May 27, 1999

[51] Int. Cl.[7] ..... A47F 5/00

[52] U.S. Cl. ..... 211/183; 211/59.2; 211/74; 312/45; 312/72

[58] Field of Search ..... 211/59.2, 59.3, 211/74, 183; 312/45, 72

[56] References Cited

U.S. PATENT DOCUMENTS

| | | | |
|---|---|---|---|
| 4,205,763 | 6/1980 | Mere | 211/59.2 X |
| 5,240,126 | 8/1993 | Foster et al. | 211/59.3 |
| 5,624,042 | 4/1997 | Flum et al. | 211/59.2 |
| 5,645,176 | 7/1997 | Jay | 211/59.2 |
| 5,695,074 | 12/1997 | Wiese | 211/59.2 |
| 5,865,324 | 2/1999 | Jay et al. | 211/59.2 |
| 5,904,256 | 5/1999 | Jay | 211/59.2 |
| 5,971,204 | 10/1999 | Apps | 211/59.2 X |

*Primary Examiner*—Robert W. Gibson, Jr.
*Attorney, Agent, or Firm*—John L. James

[57] ABSTRACT

A front panel for a display rack has a base, upstanding sidewalls connected along their bottom end portions to the base, face members connected to the front edges of the sidewalls, and an elongate connecting member connected to the top end portions of the face members. The base, face members and connecting member define a viewing window for the display rack through which a beverage container in a display rack in a refrigerator can be viewed. The base and connecting member curve outward to position a beverage container forward in the display rack.

19 Claims, 5 Drawing Sheets

FRONT PANEL FOR A DISPLAY RACK

FIELD OF THE INVENTION

The present invention relates generally to a display rack for displaying beverages in a commercial refrigerator, and, more particularly, to a front panel for such a display rack.

BACKGROUND OF THE INVENTION

Display racks are used to shelve merchandise awaiting purchase by a consumer. Some items, such as beverages, are best when consumed chilled, and are consequently shelved in a refrigerator. Display racks are used in the refrigerator to keep beverage containers upright for easy viewing and to separate them for dispensing one at a time. Beverages are removed one at a time from the front of the rack and the remaining inventory is urged to the front of the rack. Restocking conveniently occurs from the rear of the rack ensuring that beverages are chilled when they reach the front of the rack. The front of the rack is important for presentation of the beverage. Accordingly, it will be appreciated that it would be highly desirable to have a display rack that promotes easy dispensing of beverage containers and promotes easy viewing of beverage container labeling.

In some convenience stores where beverages are displayed in racks, the beverage containers are not perfectly aligned with the labels facing forward for easy viewing because of the time required to align them and because shelf stockers are generally not that attentive. Accordingly, it will be appreciated that it would be highly desirable to have a display rack that contains a place for a container label so that such a label would always face forward for easy viewing.

SUMMARY OF THE INVENTION

Briefly summarized, according to one aspect of the present invention, a front panel for a display rack comprises a base, upstanding sidewalls connected along their bottom end portions to the base, face members connected to the front edges of the sidewalls, and an elongate connecting member connected to the top end portions of the face members. The base, face members and connecting member define a viewing window for the display rack through which a beverage container in a display rack in a refrigerator can be viewed. The base and connecting member curve outward to position a beverage container forward in the display rack for easy removal. The connecting member can be enlarged to provide a space for a beverage container label so that the label faces forward for easy viewing. Such a connecting member with a label space can be integrally formed with the front panel. Where beverage selections change frequently, a separate member can be removably attached to the front panel to display a label.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
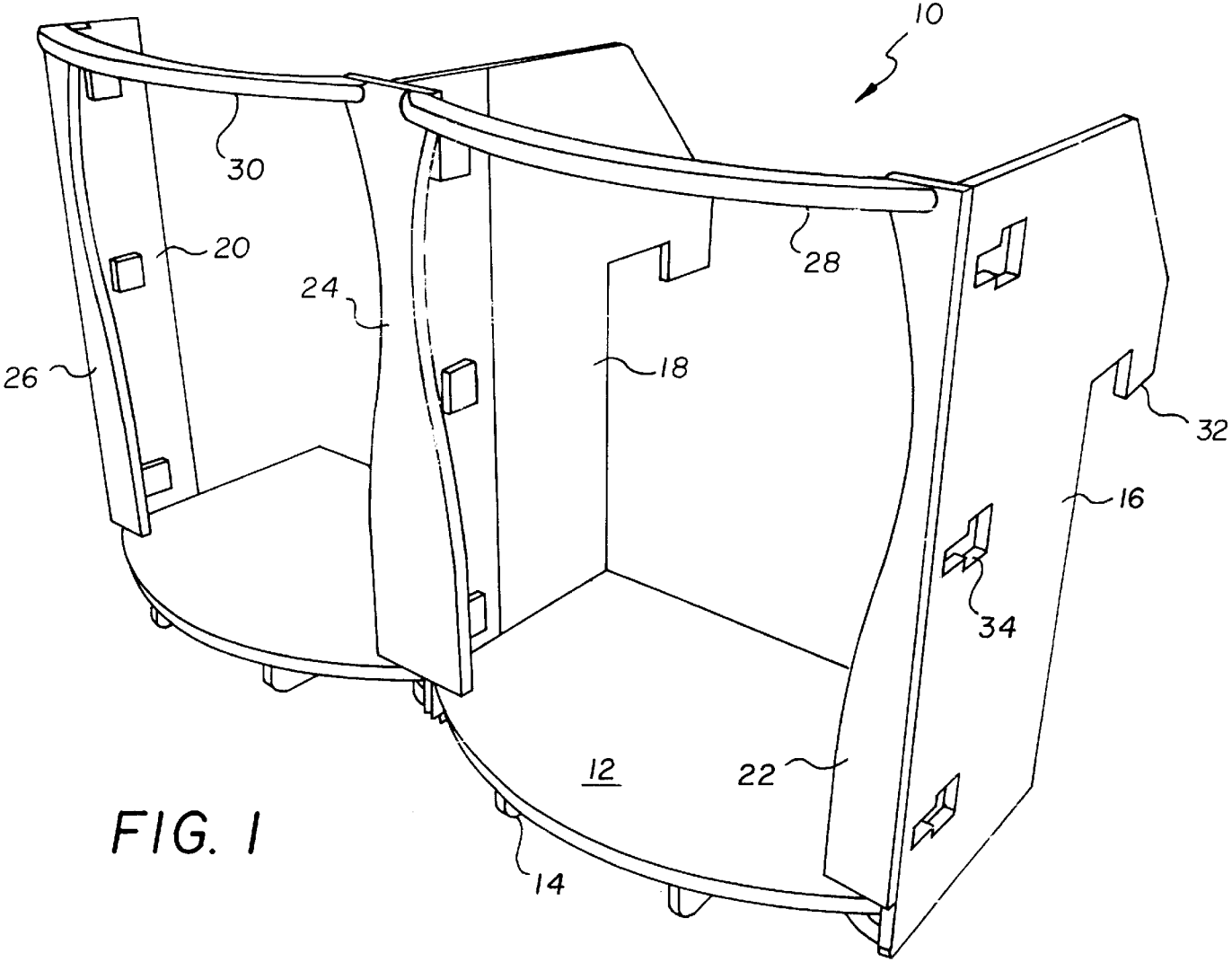
FIG. 1 is a diagrammatic front view of a preferred embodiment of a front panel for a beverage display rack according to the present invention.

Referring to FIG. 1, there is illustrated a front panel assembly 10 for a display rack, such as a display rack for a commercial refrigerator of the variety used in supermarkets and convenience stores for beverage service for example. Front panel assembly 10 is preferably a unitary structure constructed of plastic using an injection molding process, but may be constructed of other materials. The front panel assembly 10 has a base 12 with a plurality of legs 14 for supporting front panel 10. The front edge of base 12 is preferably curved or contoured to fit the contour of a beverage container. Front panel assembly 10 is illustrated as having first, second and third upstanding sidewalls 16, 18, 20 with adjacent sidewalls forming partitions to hold a row of beverage containers therebetween. While three sidewalls are illustrated, there may be as few as two sidewalls to accommodate a single row of beverage containers or as many sidewalls as are necessary for multiple rows to fill the width of the refrigerator unit. Each sidewall has a top end portion, a bottom end portion, and a front edge that extends between the top and bottom end portions of the sidewall. Preferably, each sidewall has a hook 32 formed on a rear portion thereof for connecting the sidewall to the main body of the display rack, and each sidewall defines one or more openings 34 to facilitate connecting the face panel assembly to the display rack.

The first sidewall 16 is connected along its bottom end portion to base 12 and preferably extends a distance below base 12 equal to the height of the legs 14 so that sidewall 16 supports the right edge of base 12. Second sidewall 18 is laterally spaced from first sidewall 16 and is connected along its bottom end portion to base 12. Sidewall 18 also extends below base 12 a distance equal to the height of legs 14 and supports the left side of base 12. Ideally, the lateral spacing between the first and second sidewalls 16, 18 is slightly greater than the width of the beverage container to be displayed between the sidewalls to allow easy movement of the beverage container while preventing it from tilting askew. The third sidewall 20 is connected to base 12 in similar fashion to sidewalls 16 and 18, and the second sidewall 18 is intermediate the first and third sidewalls 16, 20. As illustrated, the front panel assembly accommodates two rows of beverage containers with containers in each row aligned one behind the other.

A first face member 22 has a top end portion and a bottom end portion and is connected to the front edge of the first sidewall 16. Face member 22 extends laterally a preselected distance from first sidewall 16 toward second sidewall 18. When a beverage container is present it rests against face member 22 which prevents the container from falling out of the refrigerator when the door is opened. Face member 22 extends a distance sufficient to interfere with a beverage container to thereby restrain the container from moving forward in the rack. Face member 22 preferably has a curved, undulating, serpentine or sculptured profile for aesthetic appeal and for adding interest to the beverage container.

A second face member 24 has a top end portion and a bottom end portion and is connected the front edge of second sidewall 18. Second face member 24 extends a preselected distance from second sidewall 18 toward first sidewall 16, and also extends a preselected distance from second sidewall 18 towards third sidewall 20. Both edges of face member 24 have sculptured profiles similar to face member 22 with face member 24 resembling two face members 22 abutting one another back to back.

Third face member 26 also has a top end portion and a bottom end portion and is connected to the front edge of third sidewall 20. Third face member 26 extends a preselected distance from third sidewall 20 toward second sidewall 18, and also has a sculptured profile. The first, second and third face members 22, 24, 26 are preferably connected to base 12 but have sufficient structural integrity when connected only to the sidewalls 16, 18, 20, respectively.

Still referring to FIG. 1, a first elongated connecting member 28 has a first end connected to the top end portion of first face member 22 and has a second end portion connected to the top end portion of second face member 24. By attaching the elongated connecting member 28 to face members 22 and 24 instead of the sidewalls, a stronger union is obtained because of the larger bonding area where the connecting member and face members meet. First elongated connecting member 28 curves outward away from face members 22 and 24, and is shaped to fit the contour of a beverage container in the rack. It extends outward over the curved portion of base 12. Connecting member 28, face members 22 and 24, and base 12 form a first viewing window through which the label of a beverage container can be viewed prior to selection of a beverage from the rack. The window is slightly narrower than the beverage container to help restrain the container. The sculptured profiles of the face members increase aesthetic appeal and add interest to labels of beverage containers.

A second elongated connecting member 30 has a first end connected to the top end portion of second face member 22 and has a second end portion connected to the top end portion of third face member 26. First elongated connecting member 30 curves outward away from face members 24 and 26, and is shaped to fit the contour of a beverage container in the rack. It extends outward over the curved portion of base 12. Connecting member 30, face members 24 and 26, and base 12 form a second viewing window through which the label of a beverage container can be viewed prior to selection of a beverage from the rack.

Figure 2:
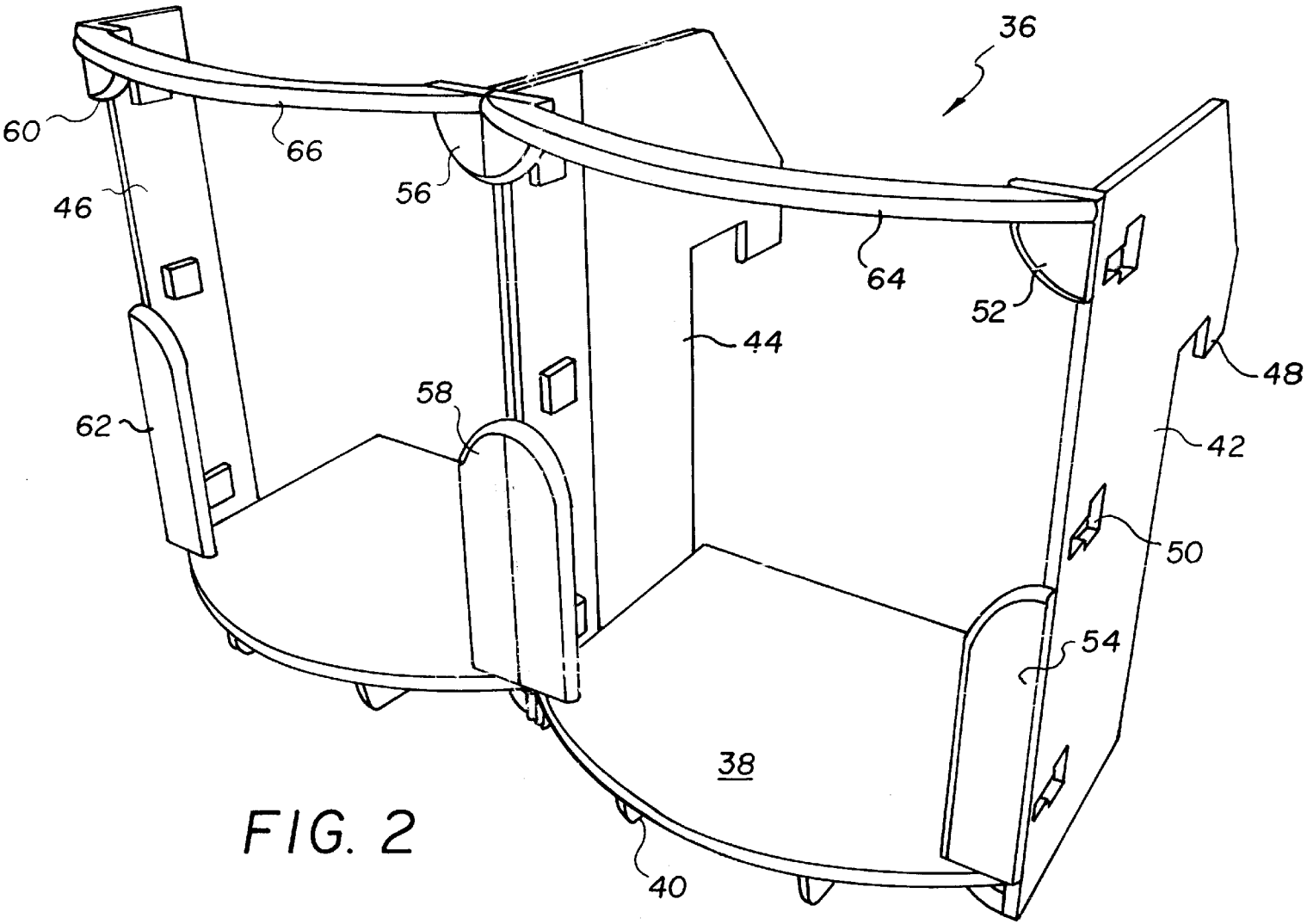
FIG. 2 is a diagrammatic front view of a preferred embodiment of a front panel for a beverage display rack similar to FIG. 1, but illustrating another preferred embodiment.

Referring now to FIG. 2, a front panel assembly 36 for a display rack has a base 38 with a plurality of legs 40 for supporting front panel 36. The front edge of base 38 is contoured to fit the contour of a beverage container. Front panel assembly 36 is shown having first, second and third upstanding sidewalls 42, 44 46 with adjacent sidewalls forming partitions to contain a row beverage containers therebetween. Front panel assembly 36 can be formed with only two sidewalls to accommodate a single row of beverage containers or with many sidewalls to accommodate multiple rows. Each sidewall has a hook 48 formed on a rear portion thereof for connecting the sidewall to the main body of the display rack, and each sidewall defines one or more openings 50 to facilitate connecting the face panel assembly to the display rack.

A first face member has a top end portion 52 and a bottom end portion 54 and is connected to the front edge of the first sidewall. The first face member extends laterally a preselected distance from first sidewall 42 toward second sidewall 44. When a beverage container is present it rests against the first face member. The top end portion 52 of the first face member is planar having a quarter round configuration with a square corner abutting the sidewall and a rounded portion extending toward the second sidewall 44. The bottom end portion 54 of the face member is planar having a curved profile with a square corner abutting the sidewall and a curved portion extending toward the second sidewall 44.

A second face member has a top end portion 56 and a bottom end portion 58 and is connected the front edge of second sidewall. The second face member extends laterally a preselected distance from second sidewall 44 toward first sidewall 42, and also extends laterally a preselected distance from second sidewall 44 towards third sidewall 46. The top end portion 56 of the second face member is planar having a semicircular configuration with the curved portion extending downward toward the base. The bottom end portion 58 of the second face member is planar having a curved profile with the curve pointing upward and a straight portion lying along the base.

A third face member has a top end portion 60 and a bottom end portion 62 and is connected to the front edge of third sidewall 46. The third face member extends laterally a preselected distance from third sidewall 46 toward second sidewall 44. The top end portion 60 of the third face member is planar having a quarter round configuration with a square corner abutting the sidewall and a rounded portion extending toward the second sidewall 44. The bottom end portion 62 of the face member is planar having a curved profile with a square corner abutting the sidewall and a curved portion extending toward the second sidewall 44.

Still referring to FIG. 2, a first elongated connecting member 64 has a first end connected to the top end portion 52 of the first face member and has a second end portion connected to the top end portion 56 of the second face member. First elongated connecting member 64 curves outward away from top face members 52 and 56, and is shaped to fit the contour of a beverage container in the rack. It extends outward over the curved portion of base 38. Connecting member 64, face members 52 and 56, and base 38 form a first viewing window through which the label of a beverage container can be viewed prior to selection of a beverage from the rack. The curved profiles of the face members increase aesthetic appeal and add interest to labels of beverage containers.

A second elongated connecting member 66 has a first end connected to the top end portion 56 of the second face member and has a second end portion connected to the top end portion 60 of the third face member. Second elongated connecting member 66 curves outward away from top face members 56 and 60, and is shaped to fit the contour of a beverage container in the rack. It extends outward over the curved portion of base 38. Connecting member 66, top face members 56 and 60, and base 38 form a second viewing window.

Figure 3:
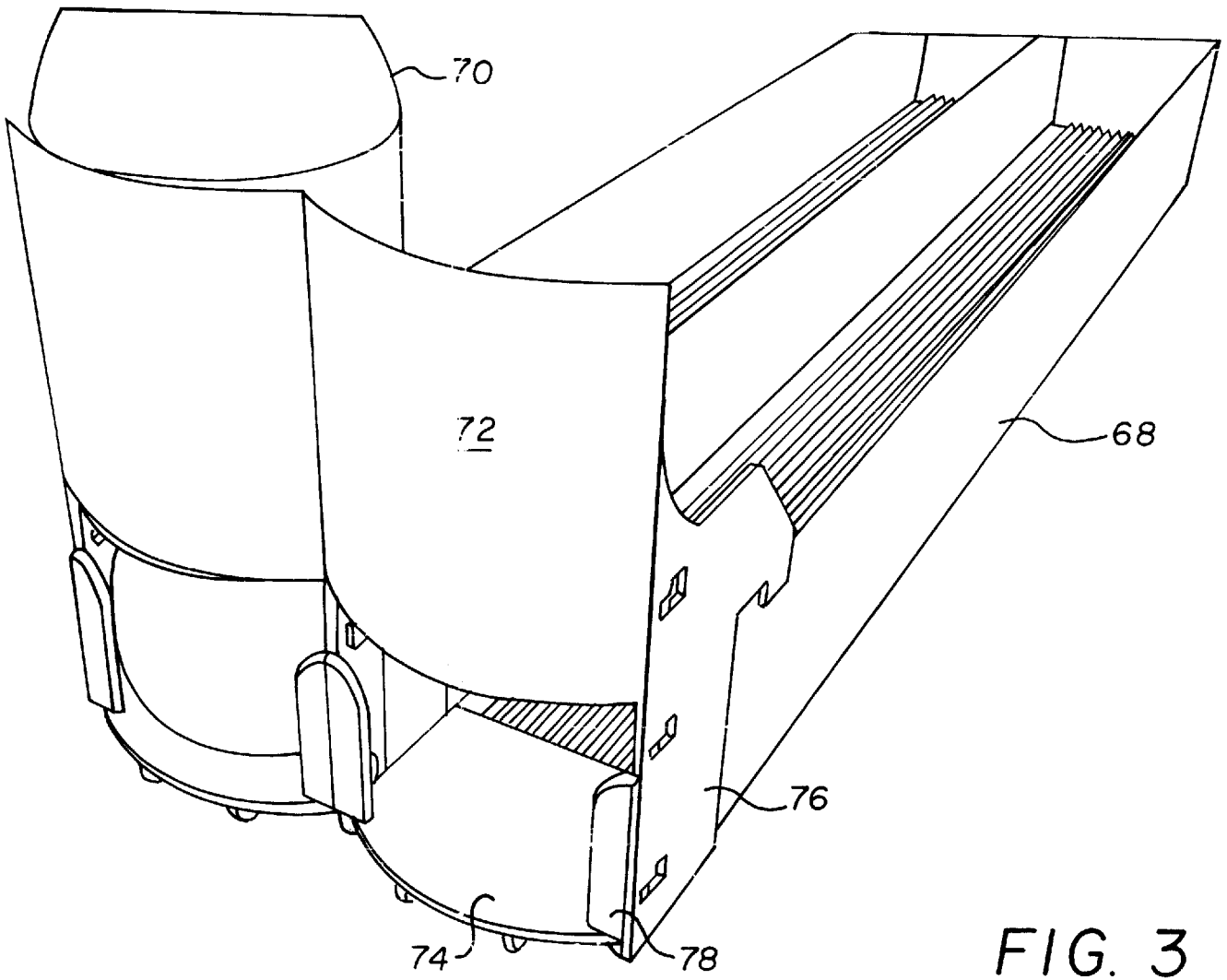
FIG. 3 is a diagrammatic perspective view of a front panel incorporating a labeling area shown attached to the display rack.

Referring now to FIG. 3 wherein another embodiment of the invention is illustrated attached to the main body 68 of a display rack with a beverage container 70 inserted. FIG. 3 is similar to FIG. 2 but the connecting member 72 has a larger surface area facing outward toward a consumer, and extends closer toward the base 74 than does the connecting member of FIG. 2. Connecting member 72 is preferably attached directly to the front edge face of the sidewall 76 but may be attached to a top end portion of a face member that is attached to the sidewall, such as face member 22 illustrated in FIG. 2. Direct attachment of connecting member 72 to sidewall 76 is preferred in this embodiment for two reasons. First, because of its large size and the fact that it extends from the top of the sidewall 76 towards the base 74 and bottom end portions 78-, it is very strong. Second, it is simple to manufacture by injection molding when directly connected.

Connecting member 72 provides a large surface area that may be transparent so that the label on beverage container 70 is visible through the surface area. Also, the surface area is large enough to have a label or decal affixed to it so that the orientation of a beverage container does not matter when a consumer is making a selection because the decal on connecting member 72 is always facing forward toward the consumer. If a specific container is to be accommodated, then the height of connecting member 72 can be adjusted to coincide with the container label. On some containers, bottles especially, the identifying portion of the label is spaced a certain distance from the bottom of the bottle so that connecting member 72 need not reach all the way to base member 74 or all the way to bottom end portions 78. When a front panel is designed for a specific container, the size and dimensions of the connecting member are calculated to match the dimensions of the container so that it covers the label area of the container. Where a specific bottle has not been selected, connecting member 72 can be sized and positioned to generally coincide with the upper half of the bottle or with the lower half of the bottle. It is also curved as is connecting member 64 of FIG. 2 to accommodate the curvature of the beverage container. FIG. 3 illustrates two front end panels with connecting members side by side but any number could be used to match the number of rows of beverage containers to be accommodated.

Figure 4:
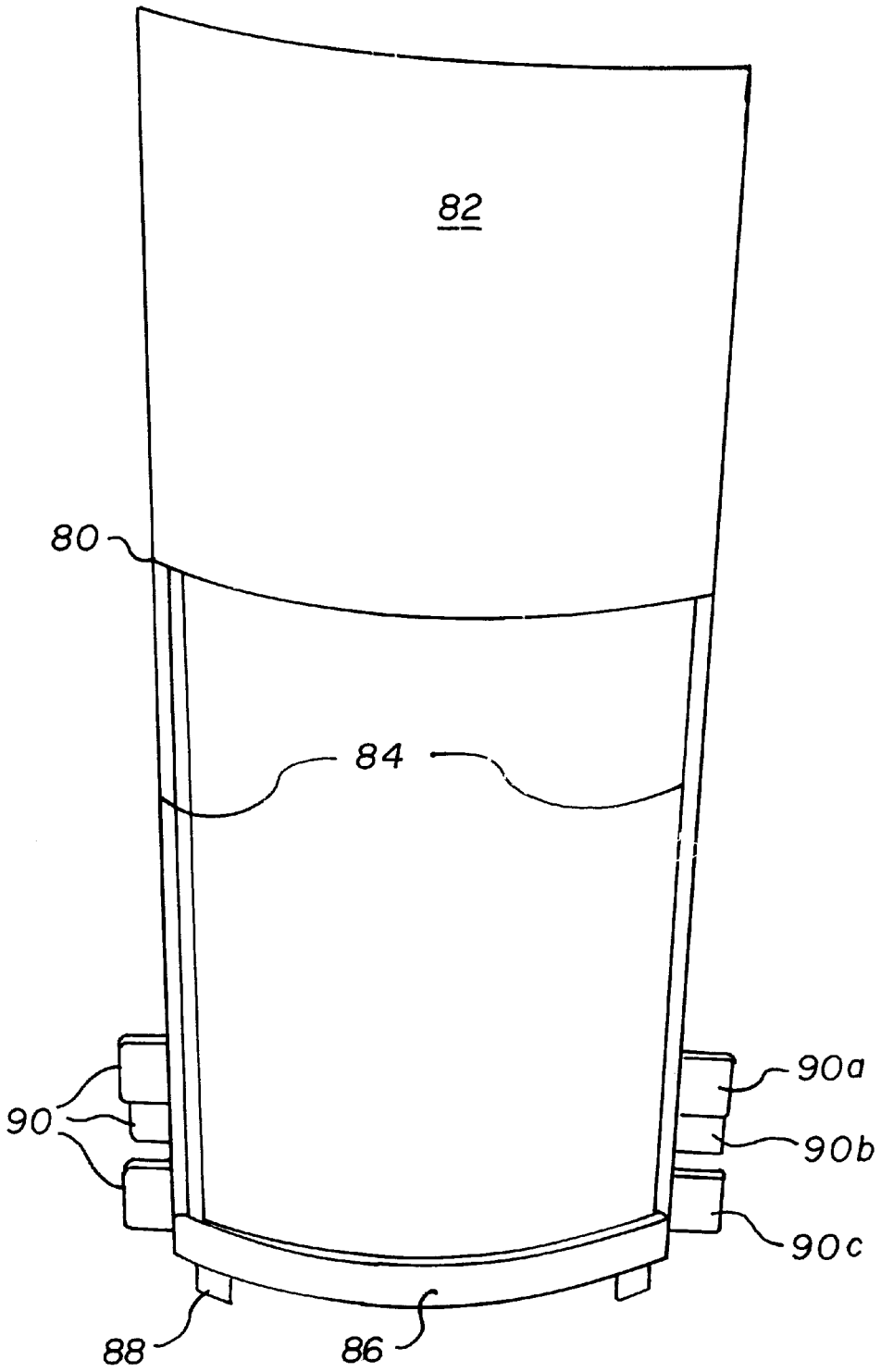
FIG. 4 is a diagrammatic front view of a removable labeling member for a front panel.
Figure 5:
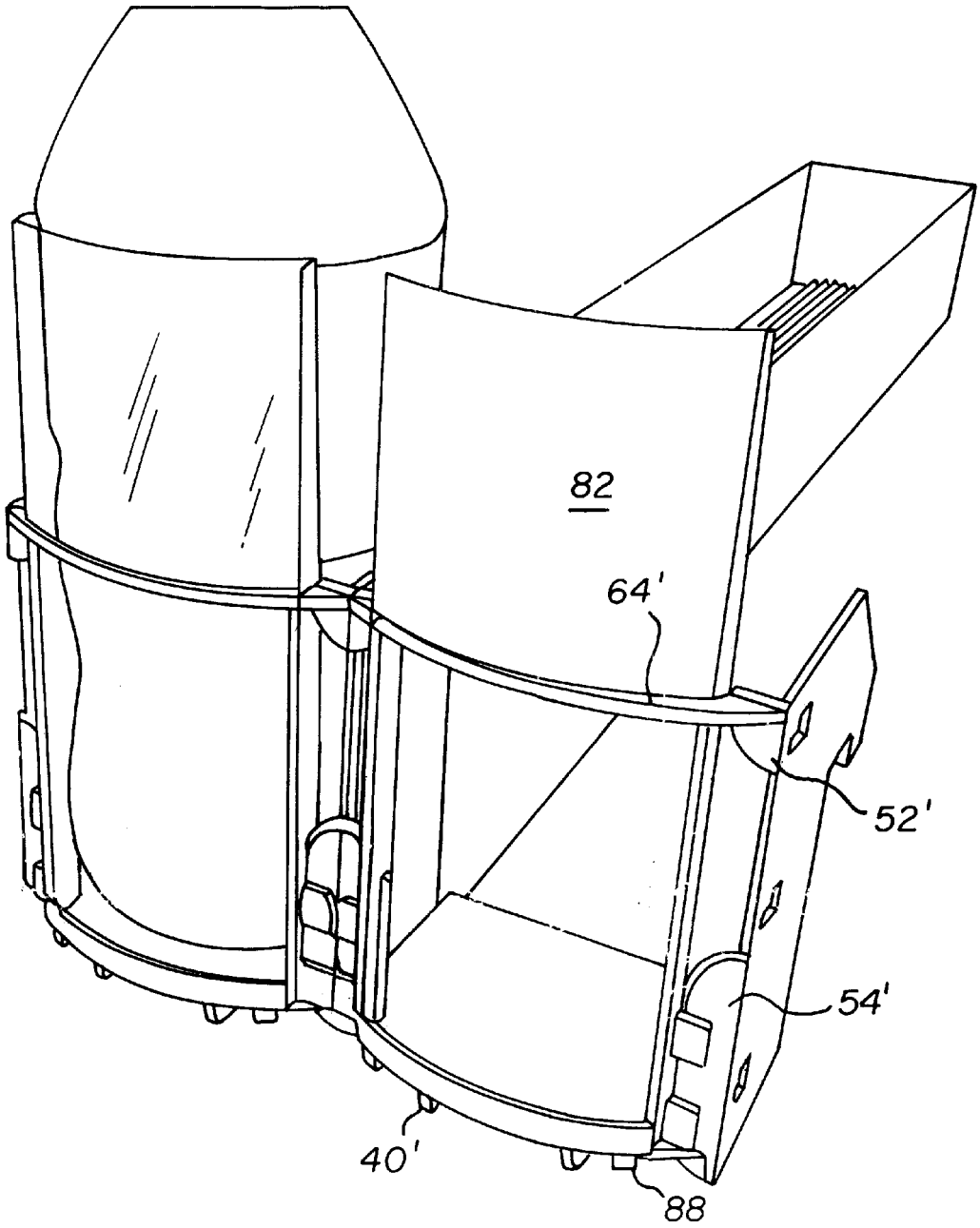
FIG. 5 is a diagrammatic perspective view of the labeling member of FIG. 4 shown attached to the front panel of FIG. 2.

Referring to FIGS. 4 and 5, a clip-on panel 80 is an alternative to the connecting member 72 of FIG. 3 with its decal area. Panel 80 has a decal area 82 for attaching a product label or decal. Decal area 82 is supported on a pair of long legs 84 extending downward from decal area 82 to a connecting base 86 which is curved to fit the contour of a bottle 92 or other container. Connecting base 86 is preferably supported on a pair of short legs 88 which separate connecting base 86 from the base 42' of the front panel and provides a channel or area between the two bases to allow any condensation to drain rather than collect and for air to circulate to help prevent condensation. Bacterial and other microbial growth is discouraged by the air circulation and moisture removal. Each of the long legs 84 has a series of laterally outward extending protrusions 90*a*, 90*b*, 90*c* that are vertically positioned one above the other. Protrusions 90*a* and 90*c* are offset to one side of a vertical line while protrusion 90*b* is offset to the other side of the vertical line forming a slot to receive one of the bottom end portions 54'. Each protrusion preferably curves slightly at its distal end to make for easier engagement with bottom end portions 54'. Clip-on panel 80 fits inside connecting member 64' and abuts top end portion 52'. The display portion has the same curvature as connecting member 64'. As illustrated, the decal area 82 extends above connecting member 64' thereby not obscuring the window area of the front panel.

A decal or label is attached on the decal area to identify the product in a particular row. Because the decal always faces forward, a high skill worker is not needed to maintain the display rack because container orientation in the rack is no longer required. Decal changes can be made by removing the existing decal and applying a new decal, by applying a new decal over an existing decal, or by replacing the entire clip-on holder. Grasping the holder connecting member and pulling straight upwards causes the protrusions on the long legs to slide up disengaging the face members regardless of whether face members are continuous or separate top and bottom face members. The process is reversed to install a new holder.

It can now be appreciated that a front cover for a display rack has been presented. According to the present invention, a front panel for a display rack has a base with first and second upstanding sidewalls attached to the base. The first sidewall has a top end portion, a bottom end portion and a front edge with the first sidewall connected along its bottom end portion to the base. The second sidewall has a top end portion, a bottom end portion and a front edge and is laterally spaced from the first sidewall and connected along its bottom end portion to the base. A first face member has a top end portion and a bottom end portion and is connected to the front edge of the first sidewall with the first face member extending laterally a preselected distance from the first sidewall toward the second sidewall. A second face member has a top end portion and a bottom end portion and is connected to the front edge of the second sidewall with the second face member extending laterally a preselected distance from the second sidewall toward the first sidewall. An elongate connecting member has its first end connected to the top end portion of the first face member and has its second end portion connected to the top end portion of the second face member. The base, face members and connecting member defining the viewing window for the display rack.

The front cover is attached to the body of the rack using hooks and openings formed on the front panel that engage members of the rack. It virtually snaps into position on the rack. The front cover holds a beverage container in position, first for viewing, and then for selection and removal from the rack by a consumer. The container is held upright and forward in the rack so that a container is always ready for removal from the rack. The contour of the front panel allows the beverage container to fit all the way forward in the rack, yet be easily lifted out of the rack. The members forming the top cross members of the viewing windows are attached to the front face panels instead of the sidewalls allowing a more conforming fit to the container without compromising structural integrity. The face members are contoured for visual appeal, but provide maximum strength with minimal dimensions which maximizes the viewing window to take full advantage of manufacturer's labeling.

The front panel can be enhanced by enlarging the connecting member to include an area large enough to accommodate a label, decal or promotional information. The decal area can be made to coincide with a specific area of a beverage container. It can be made to coincide with the label area of a container thereby effectively replacing the container label and allowing random orientation in the display rack. The front panel can also be enhanced by adding a clip-on decal holder. The clip-on holder has a connecting base supported on a short pair of legs resting on the base of the front panel. The short legs create an air space between the two bases to promote air circulation and prevent condensation. Condensation prevention is desirable to retard growth of micro-organisms and to help prevent a beverage container from slipping out of the hand of a consumer as the container is removed from the display rack. A pair of long legs rising from the connecting base support a decal holding member which extends upward from the connecting member. The long legs have protrusions forming clips to engage the face members of the display rack to hold the clip-on holder in position.

While the invention has been described with particular reference to the preferred embodiments, it will be understood by those skilled in the art that various changes may be made and equivalents may be substituted for elements of the preferred embodiments without departing from invention. For example, the lateral dimensions of the face members may be increased to accommodate narrower containers, or the decal area may exist at an angle relative to the connecting cross member or supporting legs for easier viewing. It is accordingly intended that the claims shall cover all such modifications and applications as do not depart from the true spirit and scope of the invention.

What is claimed is:

1. A front panel for a display rack, comprising:

a base;

a first upstanding sidewall having a top end portion, a bottom end portion and a front edge, said first sidewall being connected along its bottom end portion to said base;

a second upstanding sidewall having a top end portion, a bottom end portion and a front edge, said second sidewall being laterally spaced from said first sidewall and connected along its bottom end portion to said base;

a first face member having a top end portion and a bottom end portion and being connected to said front edge of said first sidewall, said first face member extending laterally a preselected distance from said first sidewall toward said second sidewall;

a second face member having a top end portion and a bottom end portion and being connected to said front edge of said second sidewall, said second face member extending laterally a preselected distance from said second sidewall toward said first sidewall; and an elongate connecting member having a first end connected to said top end portion of said first face member and a second end portion connected to said top end portion of said second face member, said base, face members and connecting member defining a viewing window for said display rack.

2. A front panel, as set forth in claim 1, wherein said first and second face members are connected to said base.

3. A front panel, as set forth in claim 1, wherein said elongate connecting member curves outward away from said face members.

4. A front panel, as set forth in claim 1, including a foot on said base for supporting said base.

5. A front panel, as set forth in claim 1, including a clip-on holder having a connecting base, a first pair of legs extending upward from said connecting base, a plurality of protrusions on said first pair of legs engaging said bottom face members, a decal holding member attached to said first pair of legs extending vertically upward from said connecting member and laterally between said top face members.

6. A front panel, as set forth in claim 5, including a second pair of legs extending downward from said connecting base to said base of said front panel to space said connecting base from said base of said front panel.

7. A front panel for a display rack, comprising:

a base;

a first upstanding sidewall having a top end portion, a bottom end portion and a front edge extending between said top and bottom end portions, said first sidewall being connected along its bottom end portion to said base;

a second upstanding sidewall having a top end portion, a bottom end portion and a front edge extending between said top and bottom end portions, said second sidewall being laterally spaced from said first sidewall and connected along its bottom end portion to said base;

a first top face member connected to said front edge along said top end portion of said first sidewall, said first top face member extending laterally a preselected distance from said first sidewall toward said second sidewall;

a second top face member connected to said front edge along said top end portion of said second sidewall, said second face member extending laterally a preselected distance from said second sidewall toward said first sidewall; and an elongate connecting member having a first end connected to said first top face member and a second end portion connected to said second top face member, said base, face members and connecting member defining a viewing window for said display rack.

8. A front panel, as set forth in claim 7, including:

a first bottom face member connected to said front edge along said bottom end portion of said first sidewall, said first bottom face member extending laterally a preselected distance from said first sidewall toward said second sidewall; and a second bottom face member connected to said front edge along said bottom end portion of said second sidewall, said second bottom face member extending laterally a preselected distance from said second sidewall toward said first sidewall.

9. A front panel, as set forth in claim wherein said elongate connecting member, base, and top and bottom face members define said viewing window for said display rack.

10. A front panel, as set forth in claim 8, wherein said first and second bottom face members are connected to said base.

11. A front panel, as set forth in claim 7, wherein said connecting member curves outward away from said face members.

12. A front panel, as set forth in claim 7, including a foot on said base for supporting said base.

13. A front panel assembly for a display rack, comprising:

a base;

a first upstanding sidewall having a top end portion, a bottom end portion and a front edge, said first sidewall being connected along its bottom end portion to said base;

a second upstanding sidewall having a top end portion, a bottom end portion and a front edge, said second sidewall being laterally spaced from said first sidewall and connected along its bottom end portion to said base;

a third upstanding sidewall having a top end portion, a bottom end portion and a front edge, said third sidewall being laterally spaced from said second sidewall and connected along its bottom end portion to said base, said second sidewall being intermediate said first and third sidewalls;

a first face member having a top end portion and a bottom end portion and being connected to said front edge of said first sidewall, said first face member extending laterally a preselected distance from said first sidewall toward said second sidewall;

a second face member having a top end portion and a bottom end portion and being connected to said front edge of said second sidewall, said second face member extending laterally a preselected distance from said second sidewall toward said first sidewall and extending laterally a preselected distance from said second sidewall toward said third sidewall;

a third face member having a top end portion and a bottom end portion and being connected to said front edge of said third sidewall, said third face member extending laterally a preselected distance from said third sidewall toward said second sidewall;

a first elongate connecting member having a first end connected to said top end portion of said first face member and a second end portion connected to said top end portion of said second face member, said base, face members and connecting member defining a first viewing window for said display rack; and a second elongate connecting member having a first end connected to said top end portion of said second face member and a second end portion connected to said top end portion of said third face member, said base, face members and connecting member defining a second viewing window for said display rack.

14. A front panel, as set forth in claim 13, wherein said first, second and third face members are connected to base.

15. A front panel, as set forth in claim 13, wherein said connecting members curve outward away from said face members.

16. A front panel, as set forth in claim 13, including a foot on said base for supporting said base.

17. A front panel for a display rack, comprising:

a base;

a first upstanding sidewall having a top end portion, a bottom end portion and a front edge extending between said top and bottom end portions, said first sidewall being connected along its bottom end portion to said base;

a second upstanding sidewall having a top end portion, a bottom end portion and a front edge extending between said top and bottom end portions, said second sidewall being laterally spaced from said first sidewall and connected along its bottom end portion to said base;

a connecting member spaced from said base and having a first side connected to said first sidewall, a second side connected to said second sidewall and a decal area extending laterally between said first and second sides and vertically a preselected distance above said sidewalls;

a first bottom face member connected to said front edge along said bottom end portion of said first sidewall, said first bottom face member extending laterally a preselected distance from said first sidewall toward said second sidewall; and a second bottom face member connected to said front edge along said bottom end portion of said second sidewall, said second bottom face member extending laterally a preselected distance from said second sidewall toward said first sidewall, said connecting member being positioned above said bottom face members and spaced therefrom forming a window between said base, bottom face members and said connecting member.

18. A front panel for a display rack, comprising:

a base;

a first upstanding sidewall having a top end portion, a bottom end portion and a front edge extending between said top and bottom end portions, said first sidewall being connected along its bottom end portion to said base;

a second upstanding sidewall having a top end portion, a bottom end portion and a front edge extending between said top and bottom end portions, said second sidewall being laterally spaced from said first sidewall and connected along its bottom end portion to said base;

a first top face member connected to said front edge along said top end portion of said first sidewall, said first top face member extending laterally a preselected distance from said first sidewall toward said second sidewall;

a second top face member connected to said front edge along said top end portion of said second sidewall, said second face member extending laterally a preselected distance from said second sidewall toward said first sidewall;

a first bottom face member connected to said front edge along said bottom end portion of said first sidewall, said first bottom face member extending laterally a preselected distance from said first sidewall toward said second sidewall;

a second bottom face member connected to said front edge along said bottom end portion of said second sidewall, said second bottom face member extending laterally a preselected distance from said second sidewall toward said first sidewall;

an elongate connecting member having a first end connected to said first top face member and a second end portion connected to said second top face member, said base, face members and connecting member defining a window; and a clip-on holder having a connecting base, a first pair of legs extending upward from said base, a plurality of clips on said first pair of legs engaging said bottom face members, a decal holding member attached to said first pair of legs extending vertically upward from said connecting member and laterally between said top face members.

19. A front panel, as set forth in claim 18, including a second pair of legs extending downward from said connecting base to said base of said front panel to space said connecting base from said base of said front panel.

* * * * *